US006216279B1

(12) United States Patent
Ellingson

(10) Patent No.: US 6,216,279 B1
(45) Date of Patent: Apr. 17, 2001

(54) SOCK ORNAMENTATION APPARATUS

(76) Inventor: Leora L. Ellingson, 10798 S. Berrywood Ct., Sandy, UT (US) 84070

( * ) Notice: Subject to any disclaimer, the term of this patent is extended or adjusted under 35 U.S.C. 154(b) by 0 days.

(21) Appl. No.: 09/148,406

(22) Filed: Sep. 4, 1998

(51) Int. Cl.[7] ..... A41B 11/00
(52) U.S. Cl. ..... 2/239; 24/DIG. 29
(58) Field of Search ..... 2/239; 24/66.1, 24/66.11, 718 K, 324, 662, DIG. 29; 604/399

(56) References Cited

U.S. PATENT DOCUMENTS 2,569,398 * 9/1951 Burd et al. ..... 2/239
4,106,126 * 8/1978 Traenkle ..... 2/240
4,296,533 * 10/1981 Doerter ..... 24/216
4,975,986 * 12/1990 Strongwater ..... 2/160
5,038,413 * 8/1991 Ursino ..... 2/239
5,308,671 * 5/1994 Wells ..... 428/99
5,325,542 * 7/1994 Lenerville ..... 2/244
5,535,448 * 7/1996 Williamson et al. ..... 2/22
5,974,590 * 11/1999 Stubbs ..... 2/239

* cited by examiner

*Primary Examiner*—John J. Calvert
*Assistant Examiner*—Katherine Moran
(74) *Attorney, Agent, or Firm*—Kirton & McConkie; Berne S. Broadbent; Keith Hargrove

(57) ABSTRACT

An assembly for removably attaching an ornament to a sock. The assembly includes a first means for attaching, the first attaching means being affixed to the sock, an ornament, and second means for attaching the ornament to the sock. The second attaching means is affixed to the ornament, and the second attaching means is configured so as to cooperate with and removably attach to the first attaching means to removably attach the ornament to the sock. As broadly described herein, the first and second attaching means may include a variety of attaching means including, for example, snap fasteners, buttons and corresponding buttonholes, hook and loop fasteners, hook-and-eye fasteners, and clasps.

12 Claims, 3 Drawing Sheets

SOCK ORNAMENTATION APPARATUS

BACKGROUND

1. The Field of the Invention

This invention relates to articles of clothing and, more particularly, to novel systems and methods for adorning socks with ornaments.

2. The Background Art

Socks with ornamental elements are available in the marketplace today. Many of these socks have small bows and/or ribbons sewn to them and are often worn by children, particularly young girls. These ornamental elements are often a color different than the color of the sock. Typically the color of the ornament is chosen to match the clothing of the child. Such matching often improves the overall appearance of a child's clothing by giving a more coordinated look.

Because the aforesaid ornamental elements are sewn to the socks, and are therefore permanently affixed to the socks, these ornamental elements need to be washable. Requiring that the ornaments be washable greatly reduces the possible materials and/or items that could be placed on socks as ornamental elements. In addition, the permanency of typical ornaments on socks limits a pair of socks to the permanently attached ornament. As a result, if one wishes to have many different ornaments to wear with socks, one typically needs to buy many different pairs of socks that have the desired ornaments.

After being washed and dried several times, and sometimes even after only one washing and drying, the ornamental elements lose some of their color and ability to maintain the same form or stiffness. Thus, over time the ornaments deteriorate in appearance to the point where they may actually detract, rather than enhance, the appearance of one's attire.

Some users of these socks with ornamental items may attempt to improve the state of the item. For example, a parent may attempt to iron a bow on a particular sock to enhance its appearance. Because these ornamental items are often rather small, it is very difficult to effectively iron them. A great deal of time could be spent trying to improve the appearance of these ornamental items, and because of their form and/or size, very little improvement in appearance may be realized.

BRIEF SUMMARY AND OBJECTS OF THE INVENTION

In view of the foregoing, it is a primary object of the present invention to provide an assembly for removably attaching an ornament to a sock.

Another object of the present invention is to provide an ornament capable of enhancing the appearance of a sock.

It is also an object to increase the number of possible materials and/or substances that can be used in constructing the ornaments.

Another object is to enable ornaments to be constructed of materials that are not readily washable.

A further object of the present invention is to increase the useful life of an ornament by enabling the item to maintain a new and sharp appearance over a longer period of time.

A still further object is to increase the versatility of a particular sock ornament.

Consistent with the foregoing objects, and in accordance with the invention as embodied and broadly described herein, an assembly for removably attaching an ornament to a sock is disclosed in one embodiment of the present invention as including first means for attaching, the first attaching means being affixed to the sock, an ornament, and second means for attaching the ornament to the sock. The second attaching means is affixed to the ornament, and the second attaching means is configured so as to cooperate with and removably attach to the first attaching means to removably attach the ornament to the sock. As broadly described herein, the first and second attaching means may include a variety of attaching means including snap fasteners, buttons and corresponding buttonholes, hook and loop fasteners, hook-and-eye fasteners, and the like.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the apparatus and methods of the present invention, as represented in FIGS. 1 through 6, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
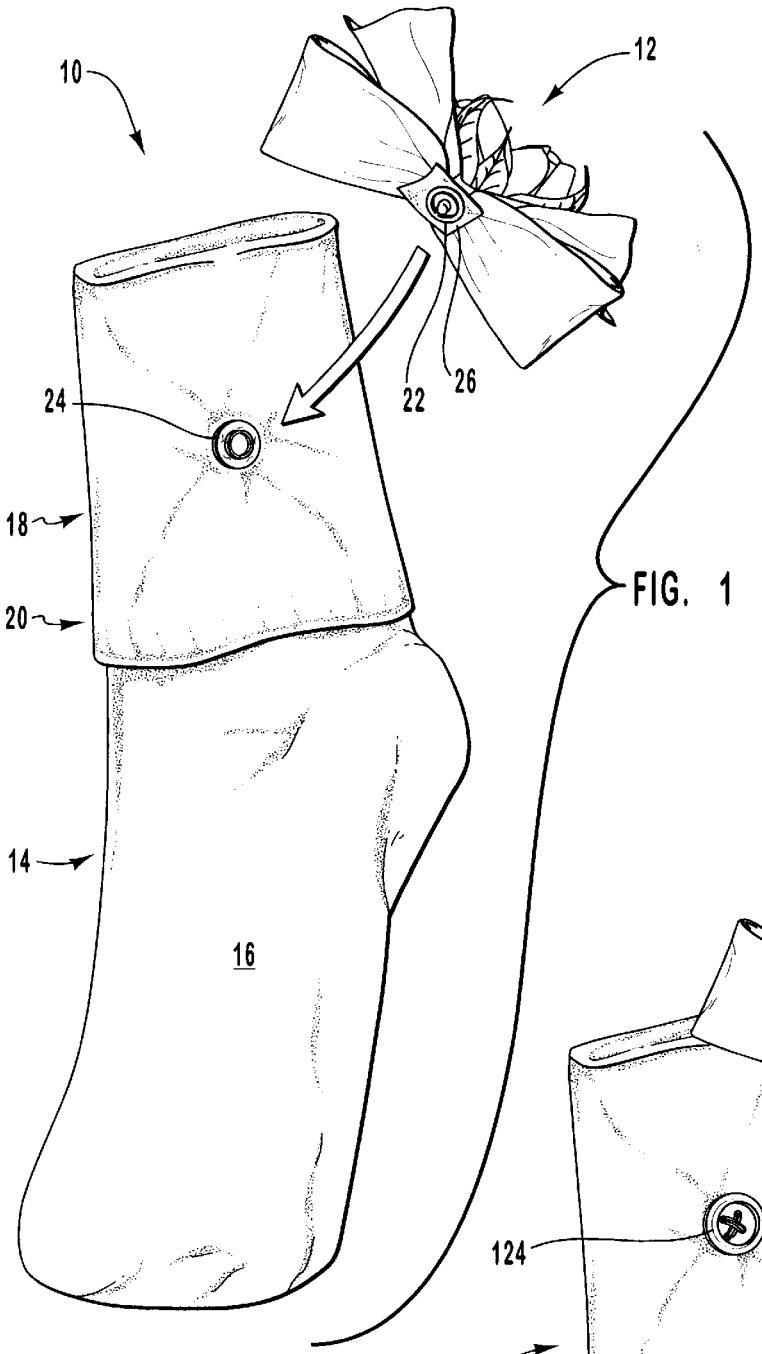
FIG. 1 is a perspective view of one presently preferred embodiment of an assembly for removably attaching an ornament to a stocking, where the ornament to be attached is a bow, and where the means for attaching the ornament is a snap fastener.

Shown in FIG. 1 is one presently preferred embodiment of an assembly 10 for removably attaching an ornament to a stocking. The stocking includes first means for attaching which is affixed to the stocking. The assembly 10 includes an ornament 12, and second means for attaching the ornament 12 to the stocking. The first attaching means is affixed to the stocking, and the second attaching means is affixed to the ornament 12. Depending upon the specific embodiment of the attaching means, different suitable methods may be used to affix the attaching means to the stocking or the ornament 12. This will be discussed further herein.

The present invention may be applied to a wide variety of stockings to facilitate removably attaching an ornament 12 to the stockings. Stockings include many different types of coverings for the feet and or legs such as socks (including socks with lace), hosiery, pantyhose, and the like. The presently preferred embodiments, as shown in the figures, illustrate the invention as disclosed herein as applied to socks 14. One skilled in the art will appreciate that the present invention could be applied to many different types of stockings.

The first attaching means and the second attaching means cooperate with one another whereby the attaching means removably attach to one another. As a result, the ornament 12 removably attaches to the sock 14 because the second attaching means, affixed to the ornament 12, removably attaches to the first attaching means which is affixed to the sock 14. Examples of possible attaching means that cooperate with one another to removably attach to one another will be further discussed herein.

The sock 14 may be divided into a foot portion 16 and an ankle portion 18. The foot portion 16 of the sock 14 is the part of the sock 14 that substantially surrounds the foot (not shown). The ankle portion 18 of the sock 14 is the part of the sock 14 that substantially surrounds the ankle (not shown) and leg (not shown). In the presently preferred embodiment, the first attaching means is affixed to the ankle portion 18 of the sock 14.

The first attaching means and the second attaching means may be structural attachment members made to cooperate and removably attach to one another. A variety of structural attachment members may be used to accomplish the first and second attaching means. Through the figures and this detailed description, several preferred embodiments will be described that are exemplary of the inventive principles contained herein.

It has been found that the first attachment member, affixed to the ankle portion 18 of the sock 14, tends to create additional stress and wear on the part of the sock 14 adjacent the first attachment member. After a period of time, such stresses often cause the sock 14 material to tear near the first attachment member. The presently preferred embodiment, as shown in FIG. 1, has the ankle portion 18 folded down to create a thick portion 20. This thick portion 20 adds strength to that part of the sock 14 where the first attachment member is secured. In addition, many wearers of these types of socks 14 at times prefer the ankle portion 18 to be folded.

Figure 4:
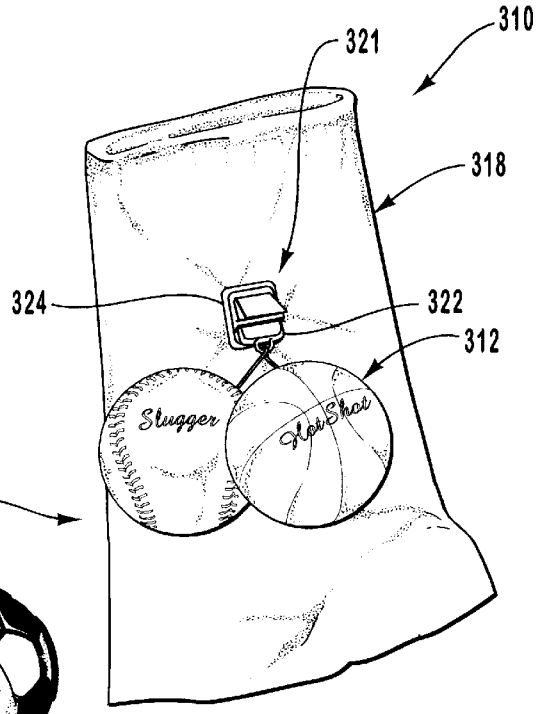
FIG. 4 is a perspective view of an alternative embodiment of an assembly for removably attaching an ornament to a stocking, where the ornament to be attached includes an ornamental baseball and an ornamental basketball, and where the means for attaching the ornament is a clasp.
Figure 5:
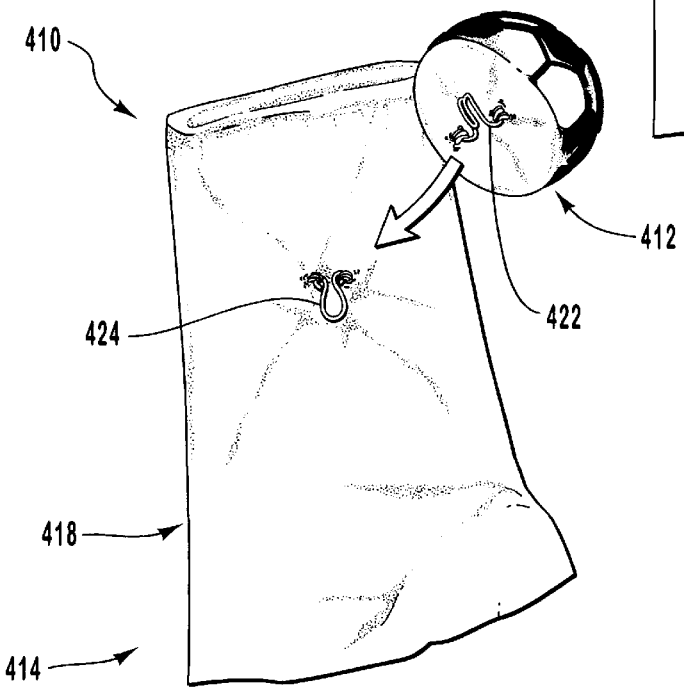
FIG. 5 is a perspective view of an alternative embodiment of an assembly for removably attaching an ornament to a stocking, where the ornament to be attached is an ornamental soccer ball, and where the means for attaching the ornament is a hook and eye fastener.

It will be appreciated, however, that the ankle portion 18 of the sock 14 does not need to be folded in order to practice the present invention. For example, FIGS. 4 and 5 illustrate such embodiments. Other embodiments may be made where the ankle portion 18 of the sock 14 is thicker by virtue of the fabrication of the material of sock 14 and not by the ankle portion 18 being folded over. A sock may be used with the present invention where the entire sock is thicker than a typical sock. Alternatively, a backing material (not shown) may be placed on the inside of the ankle portion 18 to add strength to the ankle portion 18 of the sock 14. A variety of socks, varying in length, thickness, material, etc., can be used with the present invention.

The first attaching means and the second attaching means may be achieved through many different types of fasteners. The types of fasteners used with the present invention provide a removable ornament 12 to the sock 14. Those skilled in the art will appreciate that many different types of attaching means could be used. The specific means as discussed and illustrated with the figures are only meant to be exemplary of the inventive principles contained herein, and are not meant to limit the means claimed.

As shown in FIG. 1, the first attaching means and the second attaching means may comprise one or more snap fastener. Typically snaps include a stud structure 22 (sometimes referred to as a ball structure) and a socket structure 24, where the stud structure 22 snaps into the socket structure 24. The stud structure 22 may be affixed to either the sock 14 or the ornament 12, and the socket structure 24 also may be affixed to either the sock 14 or the ornament 12. With the snap fastener shown in FIG. 1, the ornament 12 removably attaches to the sock 14 by enabling the ornament 12 to be snapped to the sock 14.

The embodiment shown in FIG. 1 has the socket structure 24 affixed to the ankle portion 18 of the sock 14. The socket structure 24 may be attached to the ankle portion 18 of the sock 14 in a variety of ways. In the presently preferred embodiment, the socket structure 24 is attached to the ankle portion 18 of the sock 14 through use of pliers (not shown) made for clamping the socket structure 24 onto a surface.

The ornament 12 in FIG. 1 is a bow 12. The stud structure 22 of the snap may be affixed to the bow 12 through use of the clamping pliers as mentioned in relation to the socket structure 24. In the presently preferred embodiment, the stud structure 22 is affixed to a ribbon 26 which is wrapped around or glued to the bow 12.

Other means may be used to attach the stud and socket structures 22, 24 to their positions besides the clamping pliers, as mentioned. For example, in mass production, an automated system may be used where a machine affixes the stud and socket structures 22, 24 to their appropriate places. The clamping pliers are simply one method which may be used to affix the stud and socket structures 22, 24.

Figure 2:
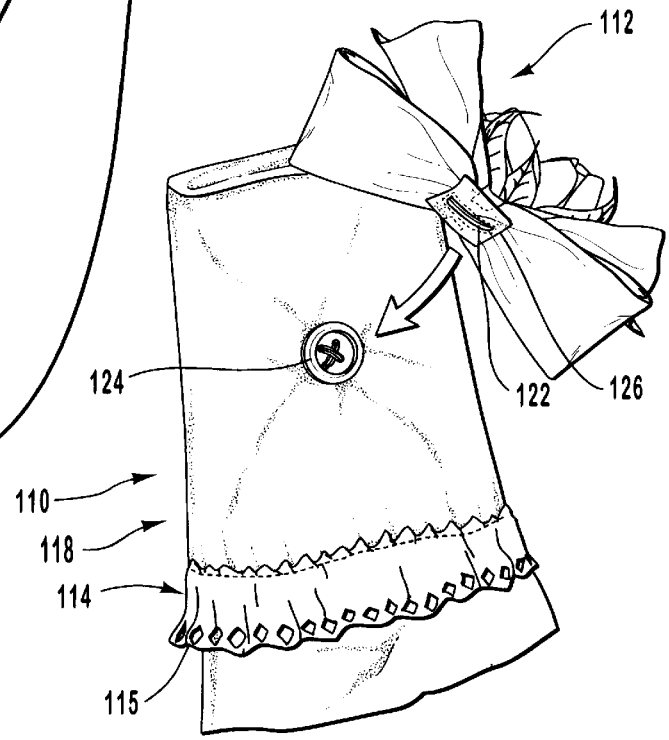
FIG. 2 is a perspective view of an alternative embodiment of an assembly for removably attaching an ornament to a stocking, where the ornament to be attached is a bow, and where the means for attaching the ornament is a button and buttonhole fastener.

Referring now to FIG. 2, the first attaching means and the second attaching means may be one or more buttons 124 and corresponding buttonholes 122 whereby the ornament 11 2 may be buttoned onto the ankle portion 118 of the sock 114. The button 124 may be affixed to either the sock 114 or the ornament 112, and the buttonhole 122 may be formed in either the sock 114 or the ornament 112. With the button 124 and buttonhole 122 fastener shown in FIG. 2, the ornament 112 removably attaches to the sock 114 by enabling the ornament 112 to be buttoned to the sock 114.

In FIG. 2 the button 124 is sewn to the ankle portion 118 of the sock 114. The buttonhole 122 has been formed in a piece 126 of material that has been glued to the ornament 112.

The sock 114 of FIG. 2 includes lace 115 around the bottom of the ankle portion 118. The lace 115 may be attached to the sock 114 in a variety of ways, as will be appreciated by those skilled in the art. The lace 115 of the embodiment in FIG. 2 is sewn to the bottom of the folded ankle portion 118, as shown.

Figure 3:
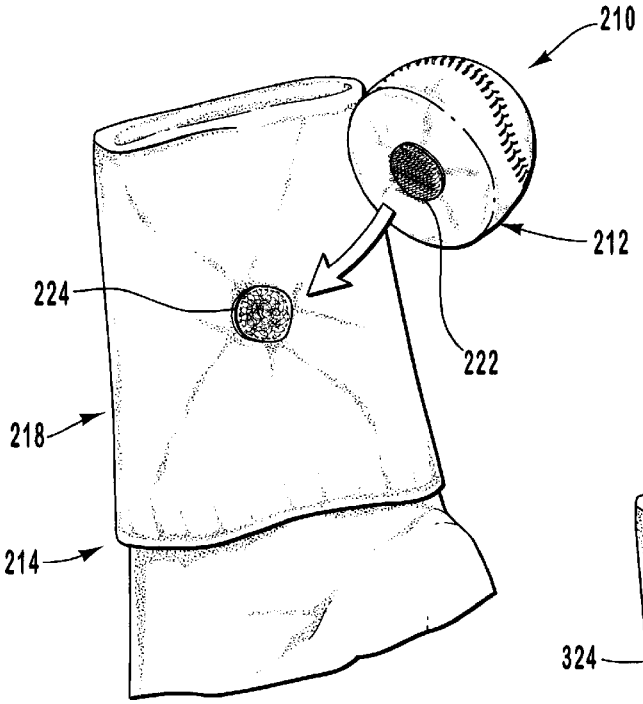
FIG. 3 is a perspective view of an alternative embodiment of an assembly for removably attaching an ornament to a stocking, where the ornament to be attached is an ornamental baseball, and where the means for attaching the ornament is a plurality of hook and loop fasteners.

Next, in FIG. 3, the first attaching means and the second attaching means may be hook and loop fasteners, commonly referred to as VELCRO™ type fasteners. In the embodiment shown in FIG. 3, a patch 222 of hook fasteners is affixed to the ornament 212 and a patch 224 of loop fasteners is affixed to the ankle portion 218 of the sock 214. One skilled in the art will appreciate that the differing patches 222, 22 4 could be attached to either the sock 214 or the ornament 212 to removably attach the ornament 212 to the sock 214.

The patches 222, 224 of hook and loop fasteners may be affixed to the sock 214 and ornament 212 in different ways. In one preferred embodiment, the patches 222, 224 may each be glued to the ornament 212 and sock 214, respectively. Some commercially available hook and loop fasteners even come with adhesive backing already in place such that the patches 222, 224 may be readily affixed to their respective surfaces. Another possible means for affixing the patches 222, 224 to their surfaces is to sew the patches 222, 224 to the surfaces.

A variety of ornaments 12 may be attached to the socks 14 to provide different aesthetic effects for appealing to different tastes. The embodiments of FIGS. 1 and 2 illustrated an ornament 12, 112 comprising a bow and flowers. As shown through FIGS. 36, different ornaments 12 may be attached to socks 14 through use of the present invention. FIG. 3 shows a baseball type of ornament 212 being removably attached to the sock 214.

The ornament 312 in FIG. 4 includes an ornamental basketball and an ornamental baseball. Each of the balls include a slogan often used in that particular sport. Different kind s of terms and/or phrases may be placed on the ornament 12 including slogans, logos, trademarks, and the like. The ornaments 12 as described herein are illustrative of some of the different approaches that can be taken in designing a sock ornament 12. Ornaments 12 could be designed and made to capture many different events, items, symbols, places, feelings, etc.

As described, the first attaching means and the second attaching means could be achieved through many different types of fasteners. The first attaching means and the second attaching means of FIG. 4 comprise a clasp 321. The clasp 321 may be made of a variety of materials including plastic. The clasp 321 includes a releasable catch 322 and a catch seat 324. In the embodiment shown in FIG. 4, the catch 322 is affixed to the ornament 312 and the catch seat 324 is affixed to the ankle portion 318 of the sock 314. One skilled in the art will appreciate that the different parts 322, 3 24 of the clasp 321 may be attached to either the sock 314 or the ornament 312 to removably attach the ornament 312 to the sock 314.

The parts 322, 324 of the clasp 321 may be affixed to the sock 314 and ornament 312 in different ways. In one preferred embodiment, the releasable catch 322 and catch seat 324 are glued to the sock 314 and ornament 312.

The socks 14, 114, 214 of FIGS. 1–3 included ankle portions 18, 118, 218 with folds in them. As discussed earlier, these folds create a thick portion 20 which adds strength to the material of the sock 14 adjacent the first attaching means. It is not necessary, however, for socks 14 of the present invention to include a folded portion 20. As shown in FIG. 4, socks 314 used with the present invention may not have a folded down ankle portion 318.

As shown in FIG. 5, the first attaching means and the second attaching means may be one or more hook and eye fasteners. In the embodiment shown in FIG. 5, a hook 422 is affixed to the ornament 412 and an eye 424 is affixed to the ankle portion 418 of the sock 414. One skilled in the art will appreciate that the either the hook 422 or the eye 424 could be attached to either the sock 414 or the ornament 412 to removably attach the ornament 412 to the sock 414.

The hook 422 and the eye 424 may be affixed to the sock 414 and ornament 412 in different ways. In one preferred embodiment, the hook and the eye parts 422, 424 are each sewn onto their respective elements. As shown in FIG. 5, the hook 422 is sewn to the cloth backing of the ornament 412, and the eye 424 is sewn to the sock 414. The ornament 412 depicted in FIG. 5 is an ornamental soccer ball 412.

Figure 6:
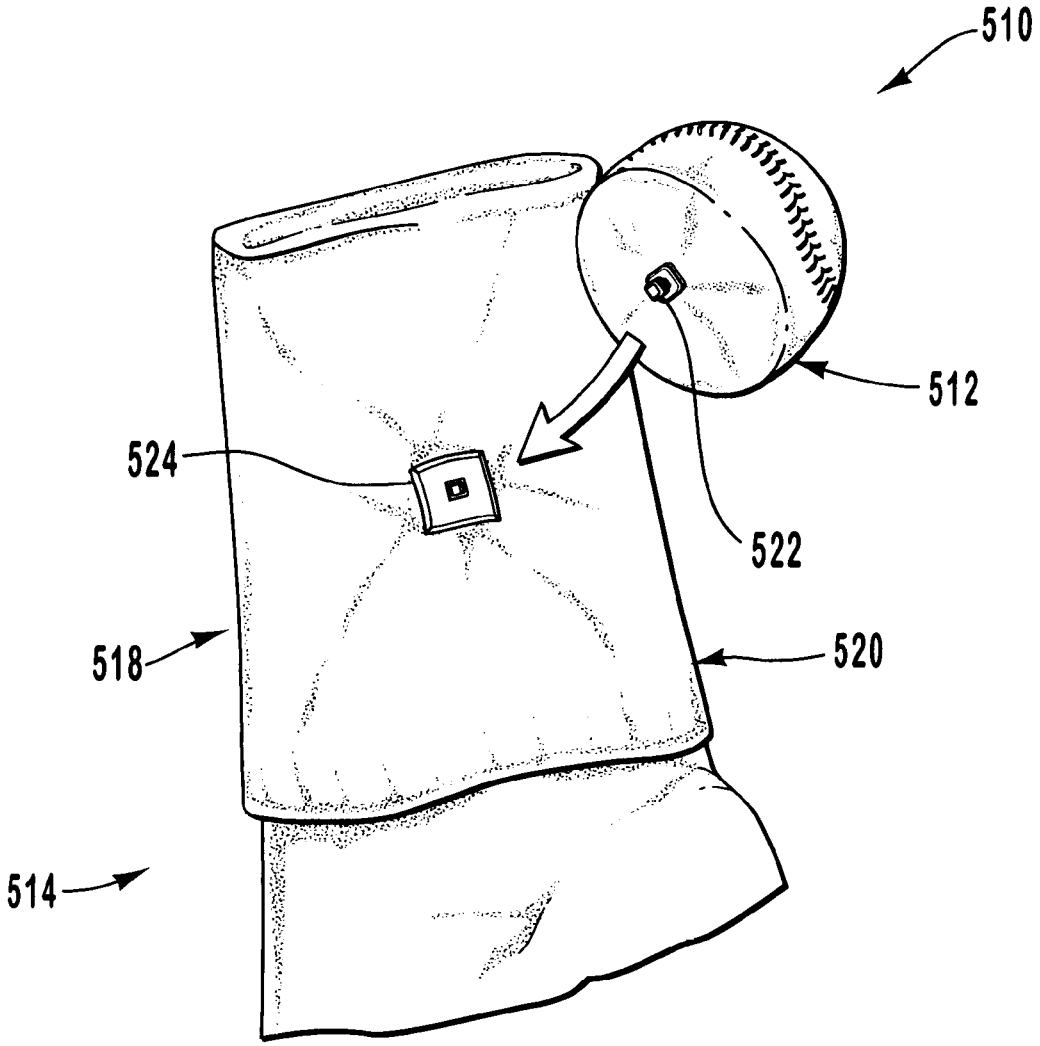
FIG. 6 is a perspective view of an alternative embodiment of an assembly for removably attaching an ornament to a stocking, where the ornament to be attached is an ornamental baseball, and where the means for attaching the ornament is a square snap fastener.

Referring now to FIG. 6, the first attaching means and the second attaching means may comprise a square snap fastener. As discussed in relation to FIG. 1, typically snaps include a stud structure 522 and a socket structure 524, where the stud structure 522 snaps into the socket structure 524. The stud and socket structures 522, 524 are square in nature with the embodiment of FIG. 6, thereby forming a square snap. The stud structure 522 may be affixed to either the sock 514 or the ornament 512, and the socket structure 524 also may be affixed to either the sock 514 or the ornament 512. With the snap fastener shown in FIG. 6, the ornament 512 removably attaches to the sock 514 by enabling the ornament 512 to be snapped to the sock 514. The square snap provides an additional feature of providing the ornament 512 with a means of attaching where the attaching means keeps the ornament 512 in a substantially fixed relationship with the sock 514. Specifically, the square snap substantially prevents the ornament 512 from rotating. The hook and loop fasteners of FIG. 3 also substantially prevent the ornament 212 from rotating, thus keeping the ornament 212 substantially fixed in relationship to the sock 214.

The embodiment shown in FIG. 6 has the socket structure 524 affixed to the ankle portion 518 of the sock 514. Ankle portion 518 further includes an optional double fold 520, like that of thick portion 20 of FIG. 1, with fastener 524 securing to both parts of fold 520. The socket structure 524 may be attached to the ankle portion 518 of the sock 514 in a variety of ways. In the presently preferred embodiment, the socket structure 524 is attached to the ankle portion 518 of the sock 514 through use of pliers made for clamping the socket structure 524 onto a surface, similar to the pliers mentioned in relation to FIG. 1. The stud structure 522 of the snap may be affixed to the ornamental baseball 512 through use of the clamping pliers as well. Of course, as discussed earlier, other means may be used to affix the stud and socket structures 522, 524 to their respective surfaces.

From the above discussion, it will be appreciated that the present invention provides an assembly for removably attaching an ornament to a stocking. The ornaments to be attached to the stocking, or sock, may enhance the appearance of a sock.

Because the ornament is removably attachable to the sock, the ornament may be constructed of a variety of materials, including those that are not readily washable. This ability to use non-washable materials in constructing the ornament increases the number of possible materials and/or substances that can be used in constructing the ornaments.

Another benefit of the present invention is that the ornament may be removed from the sock before washing the sock. This may increase the useful life of an ornament by enabling the item to maintain a new and sharp appearance over a longer period of time. In addition, the present invention increases the versatility of a particular sock ornament by allowing it to be worn with many different pairs of socks.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A sock assembly comprising:

a sock;

a first fastening device affixed to a portion of the sock proximate an ankle portion of the sock, the ankle portion being folded upon itself to form a first and second ankle portion and the first fastening device being affixed to both the first and second ankle portions;

an ornament; and a second fastening device for attaching said ornament to the sock, said second fastening device being affixed to said ornament configured to cooperate with and removably attach to said first fastening device to removably attach said ornament to the sock.

2. The sock assembly as defined in claim 1 wherein said first and second fastening devices are square.

3. An assembly for removably attaching an ornament as defined in claim 1 wherein said first fastening device and said second fastening device means comprise a button and a buttonhole whereby said ornament buttons onto the sock.

4. An assembly for removably attaching an ornament as defined in claim 1 wherein said first fastening device and said second fastening device comprise hook and loop fasteners.

5. An assembly for removably attaching an ornament as defined in claim 1 wherein said first fastening device and said second fastening device means comprise a hook-and-eye fastener.

6. A sock assembly comprising:

a sock having a foot portion and an ankle portion;

an aperture fastening device affixed to the ankle portion of the sock, the ankle portion being folded upon itself to form a first and second ankle portion and the aperture fastening device being affixed to both the first and second ankle portions;

an ornament; and a post fastening device to attach said ornament to the ankle portion of the sock, said post fastening device being affixed to said ornament, and being configured to cooperate with and removably attach to said aperture fastening device to removably attach said ornament to the sock.

7. The sock assembly as defined in claim 6 wherein said aperture and post fastening devices comprise a square snap fastener post and aperture whereby said square post fits into said square aperture allowing said ornament to snap onto the sock.

8. The sock assembly defined in claim 6 wherein said aperture and post fastening devices comprise a button and a buttonhole whereby said ornament buttons onto the sock.

9. The sock assembly defined in claim 6 wherein said aperture and post fastening devices comprise hook and loop fasteners.

10. The sock assembly as defined in claim 6 wherein said aperture and post fastening devices comprise a hook-and-eye fastener.

11. A sock assembly comprising:

a sock;

a square aperture fastening device affixed to a thick portion of the sock proximate an ankle portion of the sock;

an ornament; and a square post fastening device for attaching said ornament to the sock, said square post fastening device being affixed to said ornament configured to cooperate with and removably attach to said square aperture fastening device to removably attach said ornament to the sock.

12. A sock assembly comprising:

a sock having a foot portion and an ankle portion;

a square aperture fastening device affixed to the ankle portion of the sock, the ankle portion being folded upon itself to form a first and second ankle portion and the square aperture fastening device being affixed to both the first and second ankle portions;

an ornament; and a square post fastening device to attach said ornament to the ankle portion of the sock, said square post fastening device being affixed to said ornament, and being configured to cooperate with and removably attach to said square aperture fastening device to removably attach said ornament to the sock.

* * * * *